United States Patent [19]

Zodrow

[11] 4,040,887

[45] Aug. 9, 1977

[54] LABELLING MACHINE

[75] Inventor: Rudolf Zodrow, Dusseldorf, Germany

[73] Assignee: Jagenberg-Werke Aktiengesellschaft, Dusseldorf, Germany

[21] Appl. No.: 675,015

[22] Filed: Apr. 8, 1976

[30] Foreign Application Priority Data

Apr. 19, 1975 Germany ..... 2517442

[51] Int. Cl.[2] ..... B41M 1/00

[52] U.S. Cl. ..... 156/384; 101/216; 156/538; 156/571; 156/DIG. 11; 156/DIG. 28; 156/DIG. 37

[58] Field of Search ..... 156/277, 384, 538, 571, 156/569, 572, DIG. 11, DIG. 28, DIG. 37; 101/212, 216

[56] References Cited

U.S. PATENT DOCUMENTS

| | | | |
|---|---|---|---|
| 2,707,915 | 5/1955 | Nefzger | 156/384 |
| 3,735,731 | 5/1973 | Tavernier | 156/571 |
| 3,867,233 | 2/1975 | Eder et al. | 156/571 |

*Primary Examiner*—Edward G. Whitby
*Attorney, Agent, or Firm*—Burgess, Dinklage & Sprung

[57] ABSTRACT

The invention relates to means for printing on labels at a bottle labelling machine. The machine has glue applying means, a stack of labels and a label transfer station arranged about a circle, at least one pick-up element for the labels, a support for said pick-up element, means for rotating said support and thereby said pick-up element so that pick-up element successively receives glue, picks up a label and transfers it to another member for subsequent application to a bottle, and means for printing said labels prior to application to said bottles. In accordance with the invention the printing means comprises an inking element positioned between the glue applying means and the stack of labels. A roll having a stamp pad jacket transfers printing ink to the inking element and a brush is also provided to wipe the inking element after printing. Sun and planet gears are provided to cause appropriate pivoting of the various elements.

6 Claims, 1 Drawing Figure

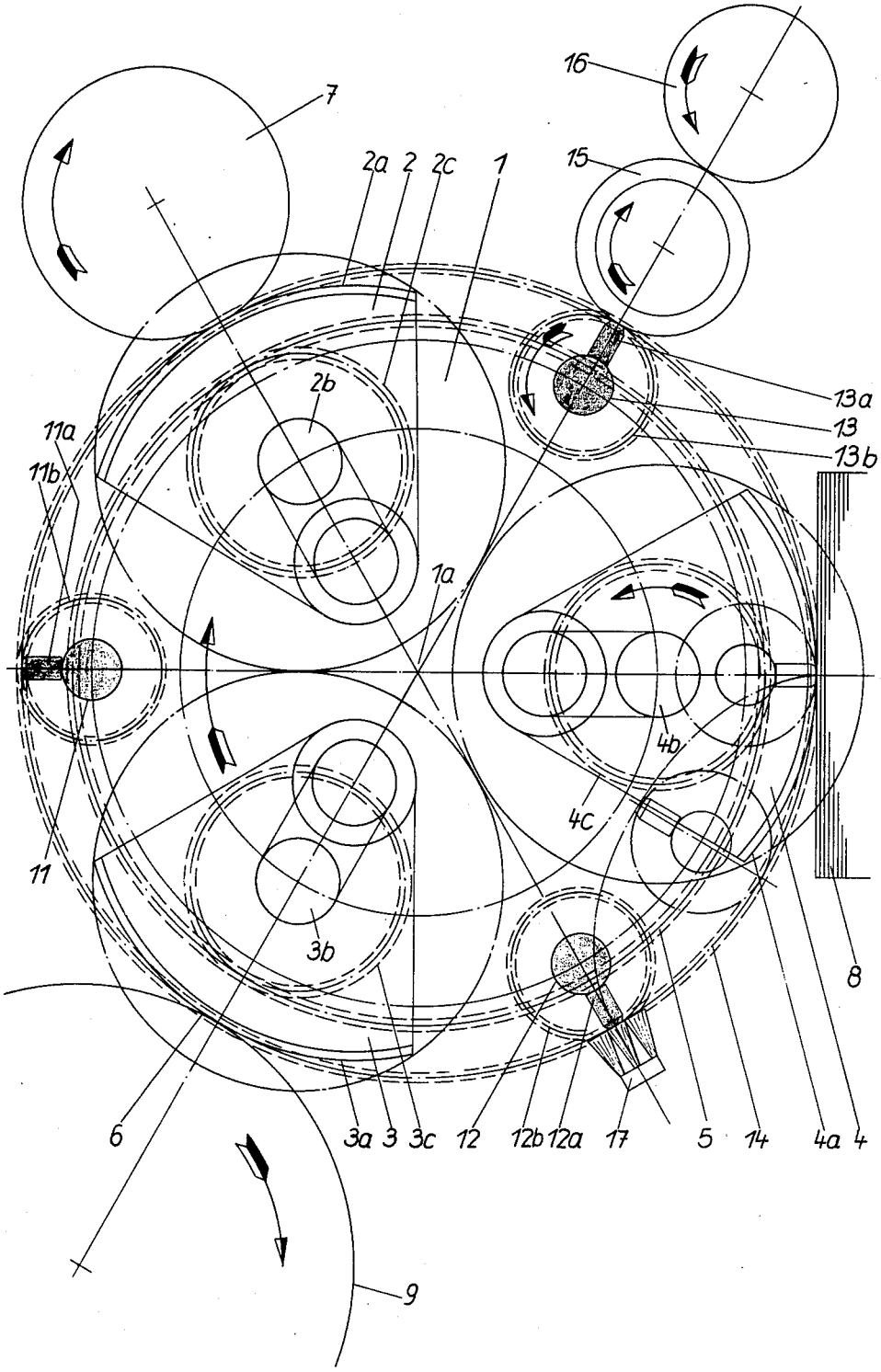
7
16
15
2a
2
2c
1
2b
13a
13
13b
11a
11b
1a
4b
4c
11
3b
8
6
3a
3
3c
12
12b
12a
17
5
14
4a
4
9

LABELLING MACHINE

The invention relates to a labelling machine for objects, in particular bottles, having several stations arranged in a circle one following the other and touching the circle tangentially and consisting of a glue applying device, a stationary label supply station, in particular a label box holding a stack of labels, and a label transfer station as well as at least one, in particular several, distributed pick-up elements for the labels which are mounted pivotally on a rotating support and which, upon each rotation of the support, pass the stations tangentially.

There has been a trend recently to provide the objects to be labelled with a characteristic marking indicating control, data or other packaging or filling data. For example, it is known to mark labels with a combination of slits at the edge. It is also known to stamp the date on the back of the labels.

In a known labelling machine this is done by moving back the labelling box after removing a label and stamping the topmost label. In heavy-duty labelling machines using a stationary labelling box it is not possible to stamp the labels in this manner.

The object of this invention is to provide a suitable stamping device for a labelling machine of the aforementioned type.

This object is realized by arranging, in the sense of rotation, behind the glue applying station and in front of the label supply station an inking element touching the circle tangentially for one or several stamp types which is or are mounted on the support behind — in the sense of rotation — each pick-up element and which is or are advanced into the tangential position by a drive upon passing the inking element and the label supply station for the purpose of inking or stamping.

Due to the fact that the stamp type is mounted on the support similarly to the pick-up elements and the inking element touches the circle tangentially in a similar manner to the glue applying station, a total sychronization between the individual elements of the labelling machine is guaranteed even in the case of maximum capacity. Preferably each stamp type is arranged in the basically triangular unused free space between two pick-up elements. The elements necessary for stamping do therefore not require any change in the compact design of the labelling machine.

As drive for the stamp type it is preferable to provide a sun gear fixedly arranged coaxially to the support axis having one planet pinion for each stamp type.

This drive ensures in simple manner that the stamp type is brought into contact with the inking element or the label at the appropriate point. Preferably the stamp type is mounted on a shaft the axis of which is parallel to the support axis. The inking element can also be a roll the axis of which is parallel to the support axis and the jacket of which is designed as a stamp pad. The flexibility of the jacket of such an inking element ensures that even if the stamp type has not completely rolled off on the stamp pad roll, the entire surface of the stamp type is inked because the inking element can be disposed in such a way that, upon passing of the inking element, the stamp type is pressed slightly into the stamp pad of the inking element. For this reason it is also possible to keep the diameter of the roll relatively small.

As a further modification, a cleaning element for the stamp type (*n*), in particular a bruch, touching the circle tangentially can be arranged — in the sense of rotation — directly behind the label supply station. In that case the stamp type is driven in such a way that the type is advanced against the cleaning element upon passing the same.

The invention is explained in more detail hereinbelow with reference to the FIGURE showing a plane view of one embodiment of a labelling station in accordance with the invention. de The labelling station of the labelling machine has a plate-shaped support 1 on which are mounted three pick-up elements 2, 3, 4 spaced by 120° each. Each pick-up element 2, 3, 4 has as contact surface a cylindrical segment 2*a*, 3*a*, 4*a* and is mounted eccentrically to the circle of this contact surface 2*a*, 3*a*, 4*a* around the axis 2*b*, 3*b*, 4*b* disposed axis parallel with the central axis. Each pick-up element 2, 3, 4 is driven by a planet pinion 2*c*, 3*c*, 4*c* that mates with a stationary sun gear 5. Upon rotation of the support 1, the planet pinions 2*c*, 3*c*, 4*c* roll off on the sun gear 5, thus rotating the pick-up elements 2, 3, 4 around their own axes 2*b*, 3*b*, 4*b*.

In the medium position of the pick-up elements 2, 3, 4 shown in the figure, they touch a circle 6 tangentially and simultaneously also a rotating glue applying roll 7, the back of the topmost label of a stationary label box 8 and a label transfer station 9 shown as rotating roll.

Upon rotation of the support 1, the pick-up elements 2, 3, 4 are rotated as result of the rolling off of their planet pinions 2*c*, 3*c*, 4*c* on the sun gear 5, viz. in an accelerated and delayed rotary movement in such a way that the contact surfaces 2*a*, 3*a*, 4*a* roll off on the surfaces of the rolls 7 and 9 and the topmost label of the label box 8. The accelerated and delayed rotary movement with uniform rotation of the support 1 is achieved by a cam control mechanism (not shown). The labelling station as far as it has been described thus far is described in more detail in German Published Specification DOS 2,325,244.

In the free lobe-like triangular space not touched by the pick-up elements 2, 3, 4 between each pair of adjacent pick-up elements 2, 3, 4 one carrier roll each 11, 12, 13, its axis being parallel with the central axis 1*a*, is provided for each stamp type 11*a*, 12*a*, 13*a* which touches the aforementioned circle 6 tangentially at predetermined points. Each roll 11, 12, 13 is driven by a planet pinion 11*b*, 12*b*, 13*b* that mates with the fixed sun gear arranged coaxially with the central axis 1*a*.

In the sense of rotation of the support 1 behind the glue applying roll 7 and in front of the label box 8 a roll 15 is mounted axis parallel with the central axis 1*a* as inking element. The surface of this roll 15 is designed as a stamp pad, i.e. it is flexible, and is arranged in relation to the circle 6 in such a manner that, upon passing, the stamp types 11*a*, 12*a*, 13*a* are slightly pressed into the jacket and thereby pick up ink. The inking roll 15 is continuously supplied with fresh ink by an application and dosing roll 16.

In the sense of rotation of the support 1 behind the label box 8 a brush 17 is arranged where the stamp types 11*a*, 12*a*, 13*a* are cleaned.

Upon rotation of the support 1 the planet pinions 11*b*, 12*b*, 13*b* roll off on the sun gear 14, thus rotating the carrier rolls 11, 12, 13 equipped with the stamp types 11*a*, 12*a*, 13*a* around their own axis. The transmission ratio is selected in such a way that, upon passing the roll 15, the label box 8 and the brush 17, the stamp types are moved, in each case, against these parts of the apparatus either picking up ink, or giving off ink, or being cleaned.

The drawing shows that, while travelling between the inking element 15 and the label box 8 as well as the label box 8 and the brush 17, the carrier rolls 11, 12, 13 rotate by 360° in relation to the support 1 in each case.

It will be appreciated that the instant specification and examples are set forth by way of illustration and not limitation, and that various modifications and changes may be made without departing from the spirit and scope of the present invention.

What is claimed is:

1. In a labelling machine for objects, such as bottles, and having glue applying means, a stack of labels, and a label transfer station arranged about a circle, at least one pick-up element for the labels, a support for said pick-up element, means for rotating said support and thereby said pick-up element so the pick-up element successively receives glue, picks up a label and transfers it to another member for subsequent application to a bottle, and means for printing said labels prior to application to said bottles, the improvement wherein said printing means comprises an inking element positioned between the glue applying means and the stack of labels and touching the circle tangentially, and an ink receiving stamping element carried by said support behind each pick-up element, whereby upon rotation of said support said stamping element is inked and after a pick-up element removes a label from the stack the inked stamping element prints the next now-uppermost label in the stack.

2. A labelling machine as set forth in claim 1, including a plurality of pick-up elements adjacent ones of which define a substantially triangular space therebetween, and a plurality of stamping elements respectively positioned in said triangular spaces.

3. A labelling machine as set forth in claim 1, including a sun gear arranged coaxially with the support, and at least one planet gear meshing with said sun gear, said planet gear being axially connected with said stamping element, whereby upon rotation of said support said planet gear rotates thereby rotating said stamping element about its axis.

4. A labelling machine as set forth in claim 1, wherein the inking element comprises a roll having an axis parallel with that of the support, the roll on its outer surface being designed as a stamp pad.

5. A labelling machine as set forth in claim 1, including a cleaning element touching the circle tangentially and arranged between the stack of labels and the label transfer station so as to wipe the inking element after the latter has printed on the topmost label of the stack.

6. A labelling machine as set forth in claim 5, including a plurality of pick-up elements adjacent ones of which define a substantially triangular space therebetween, a plurality of stamping elements respectively positioned in said triangular spaces, a sun gear arranged coaxially with the support, and at least one planet gear meshing with said sun gear, said planet gear being axially connected with said stamping element, whereby upon rotation of said support said planet gear rotates thereby rotating said stamping element about its axis, the inking element comprising a roll having an axis parallel with that of the support, the roll on its outer surface being designed as a stamp pad.

* * * * *